United States Patent [19]

Glaze, Jr. et al.

[11] 4,068,457

[45] Jan. 17, 1978

[54] BI-COMPONENT FRICTION DISC FOR YARN TEXTURING

[75] Inventors: John W. Glaze, Jr., Charlotte; Billy Mac Graves, Graham, both of N.C.

[73] Assignee: Intech Corporation, Charlotte, N.C.

[21] Appl. No.: 704,957

[22] Filed: July 13, 1976

[51] Int. Cl.[2] ..... D01H 7/92

[52] U.S. Cl. ..... 57/77.4

[58] Field of Search ..... 57/77.4–77.45

[56] References Cited

U.S. PATENT DOCUMENTS

| | | | |
|---|---|---|---|
| 3,537,250 | 11/1970 | Mackintosh | 57/77.4 |
| 3,875,734 | 4/1975 | Dupeuble | 57/77.4 |
| 3,940,914 | 3/1976 | Schuster | 57/77.4 |

FOREIGN PATENT DOCUMENTS

| | | | |
|---|---|---|---|
| 440,546 | 10/1948 | Italy | 57/77.4 |

*Primary Examiner*—Richard C. Queisser
*Assistant Examiner*—Charles Gorenstein
*Attorney, Agent, or Firm*—Schuyler, Birch, Swindler, McKie & Beckett

[57] ABSTRACT

A bi-component friction disc for imparting false twist to yarn to texture the yarn comprising an inner surface having a first portion of ceramic material surrounded by a second portion of polyurethane or rubber. Typically, one of these discs is installed on each end of a hollow tube, and two sets of tubes and discs are used in order to allow the yarn being textured to make four passes over the discs to impart the false twist.

7 Claims, 2 Drawing Figures

BI-COMPONENT FRICTION DISC FOR YARN TEXTURING

BACKGROUND OF THE INVENTION

One of the most popular manners in which to texture yarn is that of giving the yarn a ¢false twist." There are a number of ways in which false twist is imparted to yarn, and one of them is by passing it over the surface of a rotating friction disc. In a typical application, a plurality of discs are used in concert with one another, the yarn being passed over the surfaces of a plurality of discs, arranged in series with one another. In some arrangements, the external surfaces of the discs contact the yarn, while in other arrangements the yarn is passed over internal surfaces.

In both systems, the yarn usually moves longitudinally in a direction parallel to the axis of rotation of the disc, but it bends around the surface of the disc, perpendicularly to tangents to the surfaces.

The false twist is imparted to the yarn by the frictional interaction between the yarn and the surface of the rotating disc. The principle is simple, but there are some major practical problems. An effective disc must have a surface with a sufficient coefficient of friction to grasp the yarn to the extent necessary to impart the false twist. Also, it must not inhibit the longitudinal movement of the yarn, for it is being passed over the surface of the disc at a high rate of speed, typically of the magnitude of greater than 200 meters per minute. Finally, it must resist wear, so that it's life expectancy is reasonable.

Many factors affect the performance of the disc, including yarn denier, tension and surface characteristics, yarn and disc speeds, and the surface characteristics of the disc. One of the most formidable problems has been coping with the fact that the linear speed of the disc surface varies as the radius, and since the yarn contacts the surface along a radius, it is exposed to different surface speeds along the line of contact. The fastest linear speed is, of course, at the largest radius of the disc; the slowest at the smallest. Interestingly, light yarns, such as nylon in the range of 15–70 denier, can easily be effectively false twisted, by the use of a disc having a surface of rubber-like material such as rubber or polyurethane. Such material grips the yarn sufficiently to impart twist, and does not inhibit the forward passage of the yarn. The wear characteristics of such a material are acceptable. However, such is not the case with heavier yarns.

When used with heavy yarns, polyurethane and rubber discs quickly fail. They grasp the yarn sufficiently to twist it, but they impede the longitudinal movement of the yarn, and the surface of the disc begins to wear. Ridges begin to form in the inner portions of the surface, which cause the yarn to vibrate, which in turn deepens the ridges. Finally, the disc fails. There are a number of theories as to why this happens, and a key one supposes that it is caused by the exposure varying linear speeds to which the yarn is subjected as it moves from the minor to the major radius on the surface of the disc.

Many attempts have been made to solve the problems associated with false twisting heavy denier yarns. Discs having surfaces with better wear characteristics have been tried, such as ceramic and ceramic types of materials, as well as metal. These were found not to impart enough twist. As a result of the inability of those working the prior art to solve the above mentioned problem, this particular mode of false twist has not been successfully used in heavy denier yarns. Thus, the process suffers commercially.

SUMMARY OF THE INVENTION

The teachings of this invention solve the problems present in the prior art, especially when false twisting heavy denier yarns.

Accordingly, the principal object of this invention is to provide a yarn friction disc that will effectively impart false twist to heavy denier yarns, and which has a long life.

In order to accomplish this objective, a disc is provided which has a friction surface which is made of two concentric surface portions of diverse materials. A first surface portion of material having surface characteristics which provide a relatively low coefficient of friction with the yarn extends from the minor radius to an intermediate radius. A second surface portion extends from there to the major radius. The second surface is of such characteristics as to provide a relatively high coefficient of friction with the yarn. The theory is that the portion of higher coefficient of friction grasps the yarn and imparts the twist, while the other portion allows the yarn to slip upon the surface, without causing excessive wear. This construction has been found to provide excellent results with yarns of a wide denier range and does not impede the longitudinal movement of the yarn through the false twisting apparatus.

In practice it has been found that the surface of low coefficient of friction is advantageously made of ceramic or a material having a surface that has the general characteristics of the ceramic surface. The surface of high coefficient of friction can be of rubber or polyurethane material, or a material having those surface characteristics. This does not mean, however, that the surfaces cannot be of other materials, provided however, that the surfaces are treated in some way to provide the necessary characteristics.

The term "ceramic-like" as used herein is intended to mean ceramic or materials having like surface properties. The term "rubber-like" is intended to define materials having the surface properties of rubber or polyurethane. The term "flared" is used to describe the inner surface of the disc. In cross-section, this can be smooth or compound curve, or variations thereof, and might even include straight-line portions.

Figure 1:
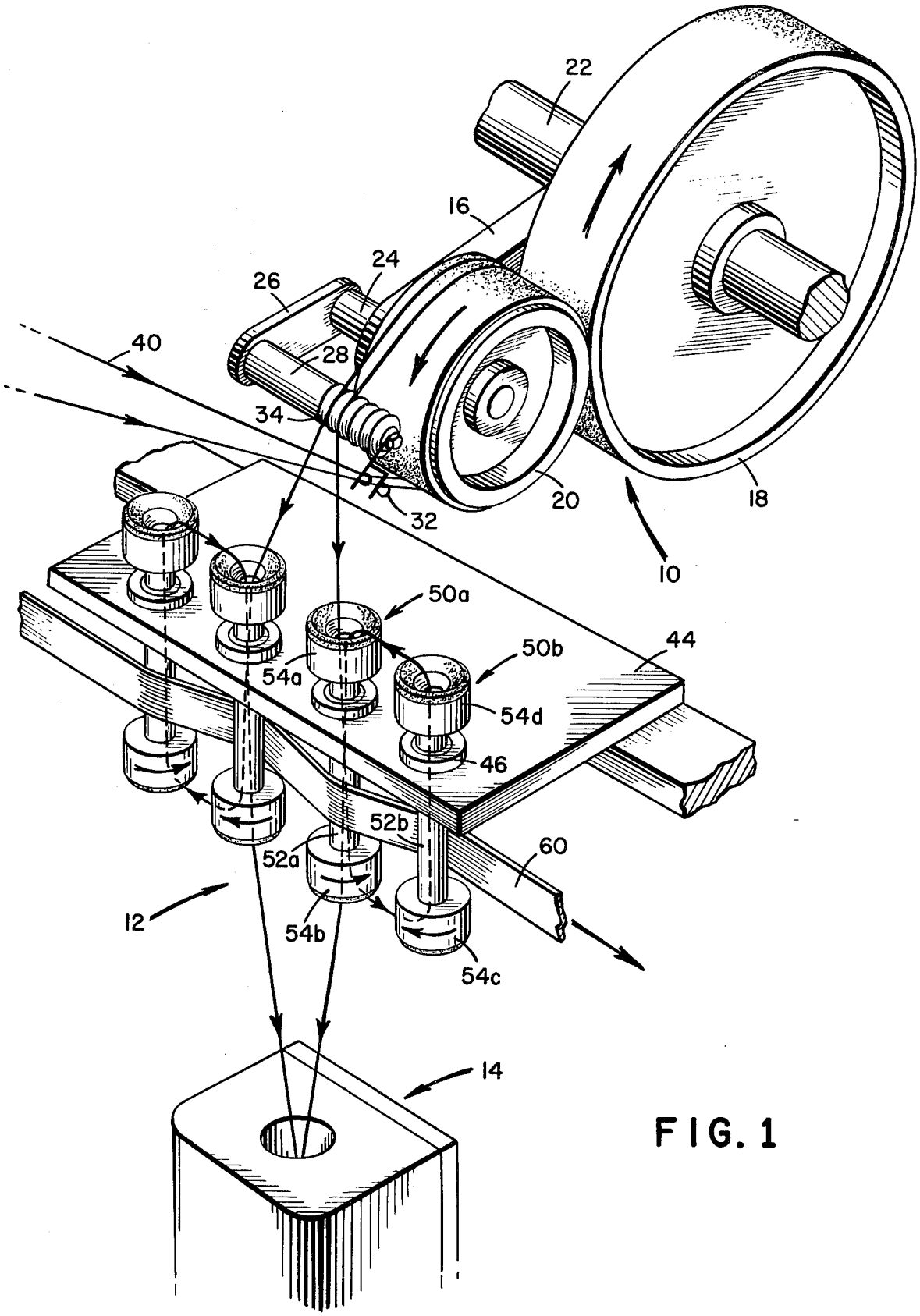
FIG. 1 shows a yarn false twist apparatus embodying the teachings of this invention.

The friction disc described herein is an internal disc, wherein the yarn passes through a center opening and contacts an internal surface. The teachings of the invention are also applicable to the external type of disc, wherein the yarn contacts as external surface.

The yarn processing apparatus shown comprises three major components, a yarn feed mechanism indicated generally at 10, a false twist mechanism indicated at 12, and a yarn treating device indicated generally at 14, such as a heater. The yarn feed mechanism comprises a frame 16 upon which is mounted a pair of feed rollers 18 and 20, which cooperate to form a nip therebetween. Feed roll 18 is mounted upon a driven shaft 22 and rotates in the direction indicated. Feed roll 20 is driven by its peripheral contact with roll 18, and is rotatively mounted upon a shaft 24. A bracket 26 carries a post 28 upon which are mounted a first guide means 32, in the form of a wire frame comprising two eyelets, and a second guide means 34, which is comprised of a grooved spindle. The incoming strands of yarn, designated as 40, pass first through guide 32 then around roll 20, and finally over the second guide 34 to the false twist mechanism.

Draw can be applied to the yarn as it is passed through the false twist mechanism, and the nip between rolls 18 and 20 acts as the upper fixed point for the drawing operation. The construction and operation of the foregoing components is well known in the art and need not be set forth in detail.

A false twist mechanism support frame 44 is mounted adjacent to the feed structure. Support 44 is provided with a plurality of openings, in this case four openings, in which are installed four bearing means 46. Again, this structure is well known in the art and need not be described in detail. Mounted in each of bearings 46 is a vertically oriented hollow spindle indicated generally as 50. Each spindle 50 is comprised of a center or tube portion 52, upon each end of which is mounted a friction disc 54. Spindles 50 rotate freely in bearings 46, driven in rotation by a moving belt 60, which in turn is driven by a mechanism, not shown. Belt 60 is threaded through adjacent of the spindles 50, so that alternate spindles turn in opposite directions. The reason for this will be explained below.

The two strands of yarn 40 follow separate paths, but each is exposed to the same treatment. As the yarn strand leaves guide 34, it passes over the edge of the upper disc **54*a* of a first spindle 50, and then downwardly through the center of the tube. The yarn emerges from the tube, makes a 90° change of direction in contact with the surface of a second disc 54*b*, and then makes another 90° change of direction in contact with the surface of disc 54*c*. It passes upwardly through the second spindle tube, emerges across disc 54*d*, and then moves across disc 54*a* and back into the spindle. Finally, it exits and moves to device 14. In all, the yarn makes four full 90° bends around a rotating disc, in order to be false twisted. As shown in FIG. 1, the first spindle 50 is turning counterclockwise, while the second spindle 50** turns clockwise. This is done in order to have the yarn twisted in the same direction through both its downwardly and upwardly passes.

Figure 2:
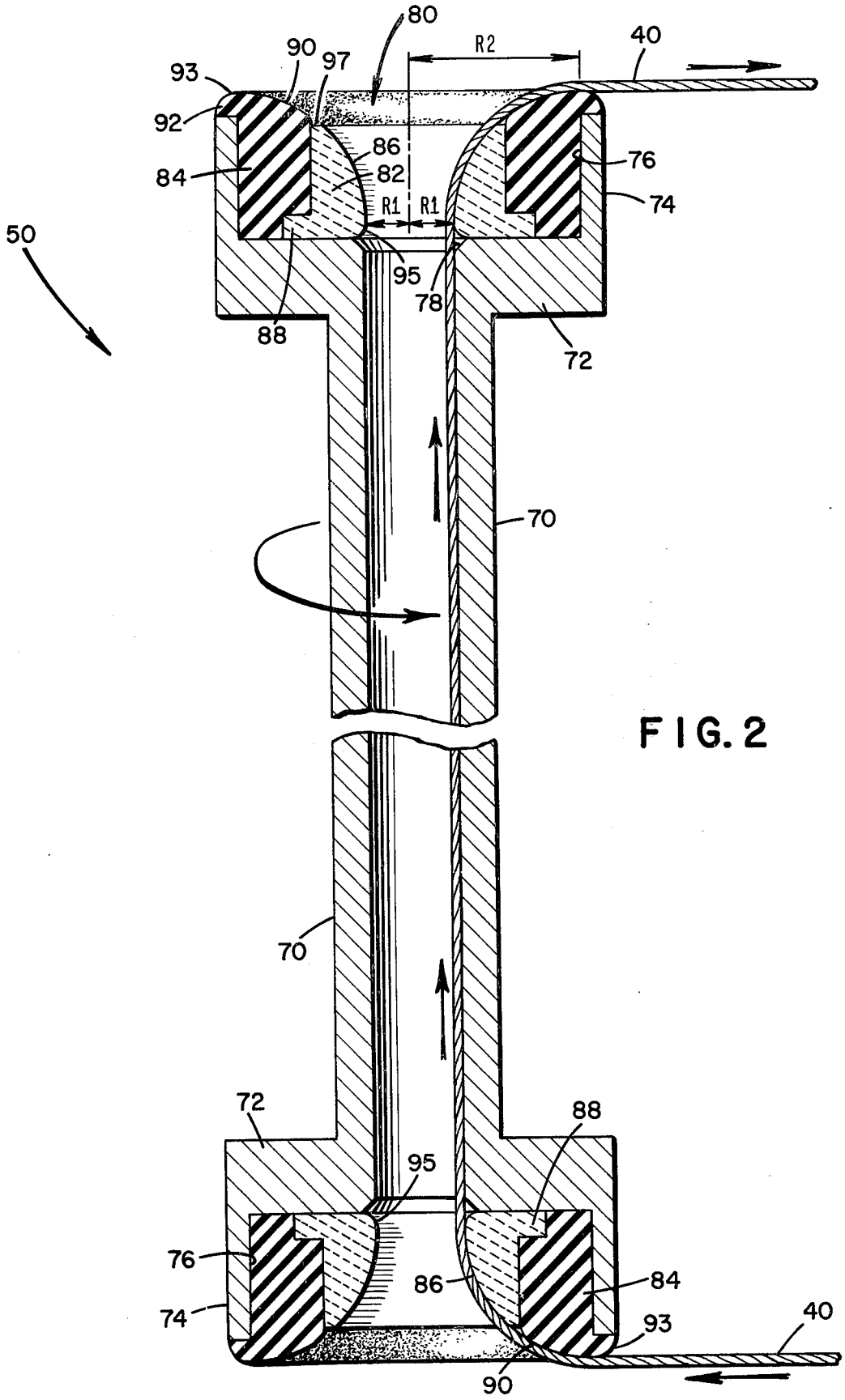
FIG. 2 is a side view, in elevation, of a yarn false twist spindle incorporation the bi-component friction disc of this invention.

A closeup look at a single spindle 50 is shown in FIG. 2. In this showing, each spindle 50 consists of a center tube portion 70 which terminates at each end in a disc support having a base portion 72 and an annular upstanding flange 74, which together define a cylindrical interior cavity 76. A yarn twisting disc 80 is installed at each end of the spindle in the recesses 76. Each disc 80 comprises an inner portion 82 of material of relatively low coefficient of friction, such as a ceramic-like material and an outer portion 84 of material of a high coefficient of friction, such as a rubber-like material.

The surface contacting the yarn is a smooth curved surface, which can be of single or compound curvature, or can conceivably have some straight portions. This surface extends from a minor radius R1 to a major radius R2, and is actually composed of two surface portions. A first surface portion 86 extends from radius R1 to an intermediate radius, particularly selected to provide the desired relatively low friction surface characteristics. A second surface portion 90 extends from this point to radius R2, and is of material of higher friction characteristics. Inner portion 82 has an annular anchoring flange 88, and outer portion 84 has an overlay rim 92. The yarn enters and exits the disc tangentially to the inner surface, changing direction by 90°. Surface portion 86 mates smoothly with the interior surface of sleeve 70, so as to allow the yarn to make a smooth transition between the two.

Disc 80 can be held in recess 76 by a number of means, including pressure fit by virtue of the interrelationship of the outer surface of portion 84 and the inner surface of flange 74, or it can be attached by means such as a cement.

Surrounding outer surface portion 90, on annular rim 92, is a rim surface 93, which curves away from a tangent to outer surface 90 at the major axis. This insures smooth entry and exit of the yarn from the disc. A similar curve 95 exists adjacent to the minor axis. A slight gap 97 can be present where the inner and outer portions meet, at the intermediate axis, to insure the presence of a smooth curve, in the face of possible manufacturing inaccuracies.

The operation of the spindle of FIG. 2 should be clear from a study of that view. The yarn is shown entering at the bottom, where a twist is imparted by its contact with the lower disc. The yarn passes over the inner surface portion 86 of the disc, and then contacts with the interior surface of sleeve 70. It emerges from sleeve 70, contacts inner surface portion 86 of the upper disc, and has more twist imparted by outer surface portion 90 of the upper disc.

Typically, a spindle is rotated at 10–15 thousand revolutions per minute, which places upon the yarn about one million revolutions per minute. The yarn has a longitudinal throughput of about 200–600 meters per minute. Typically, the yarn is given four passes over false twist spindles, and a typical machine has 120 spindle systems, each spindle system consisting of two spindles with discs mounted on each end of each shaft.

The distance the yarn travels across each of the two surface portions (the width of each) in the embodiment shown is about equal. The relative sizes of the two surface sections can be varied from that, however, depending upon such factors as the type and size of the yarn, and the velocity of the disc. The inventive concept herein set forth is operable on discs of a wide variety of sizes. For example, discs of relatively large size can be successfully used, if constructed in accordance with these teachings. The cross-sectional curvature of the interior surface can also be varied from that which is shown. For example, the first surface portion may be of lesser radius of curvature than the second surface portion, or vice versa.

Although but a single preferred embodiment has been described above, it should be understood that one skilled in the art might see a number of possible variations and modifications. Particularly, it should be realized that the inventive concepts set forth above are equally applicable to other types of friction discs, such as those in which the yarn contacts external surfaces. It should be understood that the scope of the invention is governed only by the breadth of the appended claims.

I claim:

1. A rotatable friction disc for imparting twist to a yarn comprising an annular flared friction surface symmetrically disposed about an axis of rotation and terminating at one end in a minor radius defining an opening and at the other end in a major radius, said friction surface defining in cross-section a substantially smooth curve and having a first surface portion extending from said minor radius to a point intermediate said radii and a second surface portion extending from said intermediate radius to said major radius, said first surface portion being of a ceramic-like material having a relatively low coefficient of friction with said yarn and said second surface portion being of a rubber-like material having a relatively high coefficient of friction with said yarn.

2. A friction disc in accordance with claim 1 installed at each end of a hollow tube, the inside radius of said tube being substantially equal to said minor radius.

3. The disc of claim 1 wherein said first surface portion is carried by an inner ring having an outwardly extending shoulder, and said second surface portion is carried by an outer ring having a recess for receiving said shoulder.

4. The disc of claim 3 wherein said outer ring has a central bore disposed about said axis of rotation of radius substantially equal to the radius at said point, and said inner ring is received in said bore.

5. The disc of claim 1 further comprising a rim portion annularly disposed about said second surface portion at said major radius thereof, said rim portion being curved away from a tangent to said second surface portion at said major radius.

6. The disc of claim 1 wherein a tangent to said curve at said minor radius is substantially parallel to said axis of rotation, and a tangent to said curve at said major radius is substantially perpendicular to said axis of rotation.

7. The disc of claim 1 wherein the radius of said surface at said intermediate point is about twice said minor radius.

* * * * *